US005387150A

United States Patent [19]

Terrell

[11] Patent Number: 5,387,150

[45] Date of Patent: Feb. 7, 1995

[54] UNDERWIRE BRA

[76] Inventor: Linda L. C. Terrell, 322 Camp Livingston Rd., Pineville, La. 71360

[21] Appl. No.: 45,728

[22] Filed: Apr. 14, 1993

[51] Int. Cl.[6] ..... A41C 3/10; A41C 3/14

[52] U.S. Cl. ..... 450/41; 450/47; 450/51; 450/52; 2/73

[58] Field of Search ..... 450/41, 42, 43, 44, 450/45, 46, 47, 48, 49, 50, 51, 52, 53; 2/73, 109, 110

[56] References Cited

U.S. PATENT DOCUMENTS

| | | | |
|---|---|---|---|
| 1,472,796 | 11/1923 | Fritz | 450/48 |
| 1,837,958 | 12/1931 | Willmann | 450/46 |
| 2,605,468 | 8/1952 | Kramer | 450/51 X |
| 2,762,055 | 9/1956 | Bermueller | 450/51 |
| 2,829,650 | 4/1958 | Guide | 450/49 X |
| 3,312,223 | 4/1967 | Wilson | 450/45 |

FOREIGN PATENT DOCUMENTS

| | | | |
|---|---|---|---|
| 0245673 | 5/1963 | Australia | 450/48 |
| 1085245 | 1/1955 | France | 450/45 |
| 1088481 | 3/1955 | France | 450/46 |

*Primary Examiner*—Jeanette E. Chapman

[57] ABSTRACT

An improvement in underwire bra construction wherein the ends of the U-shaped underwire are secured to complementary fastening members affixed to the material of the bra cup and wherein such U-shaped underwire is free to swing up or down relative to said complementary fastening members.

7 Claims, 5 Drawing Sheets

FIG 3
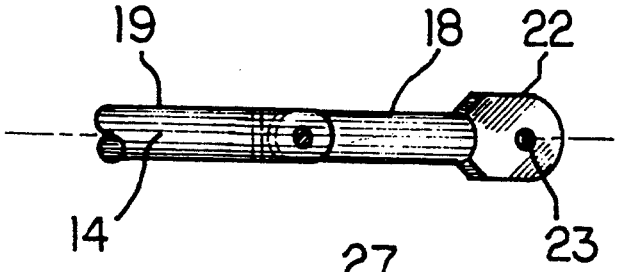
FIG 4
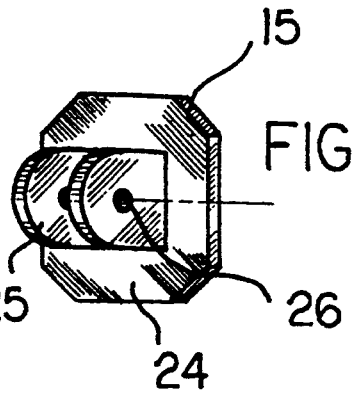
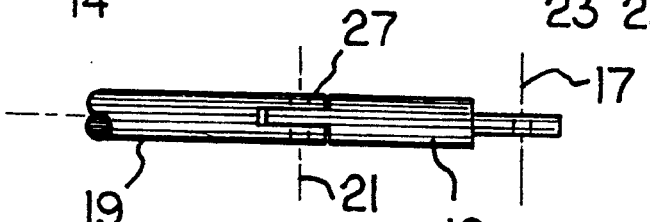
FIG 5
FIG 6
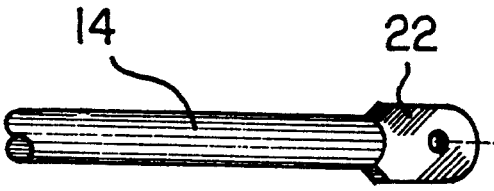
FIG 7
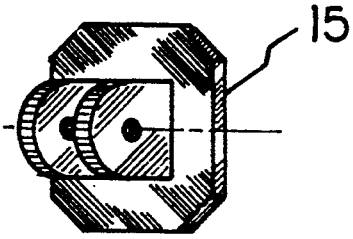

FIG 8
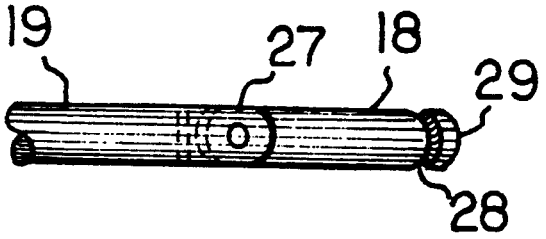
FIG 9
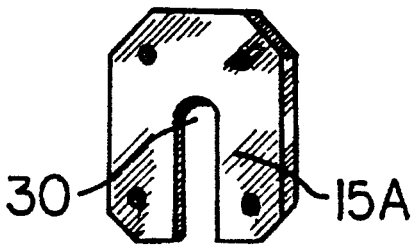
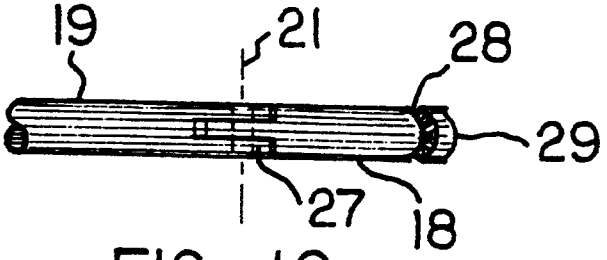
FIG 10
FIG 11
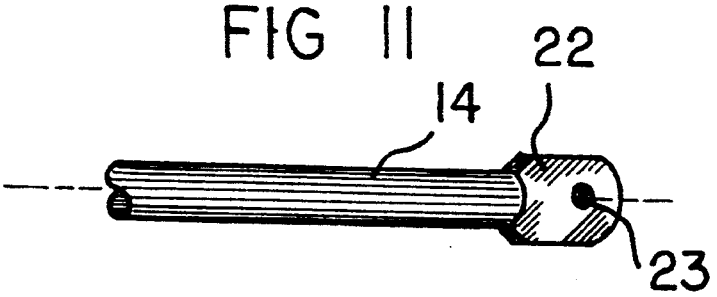
FIG 12
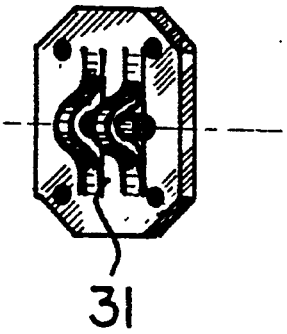

UNDERWIRE BRA

BACKGROUND OF THE INVENTION

1. Field of the Invention

The present invention relates to underwire bras and more particularly pertains to means for affixing the underwires so as to eliminate any tending for the ends thereof to punch through the fabric of the bra to which they are attached.

2. Description of the Prior Art

The use of underwire bras is known in the prior art. More specifically, U-shaped underwires heretofore devised and utilized for the purpose of insertion into women's bras are known to consist basically of familiar, expected and obvious structural configurations, notwithstanding the myriad of designs encompassed by the crowded prior art which have been developed for the fulfillment of countless objectives and requirements. Despite their use in a variety of bra designs, the U-shaped underwires have usually been slideably inserted into fabric sleeves and in use have a tendency to wear the fabric material of the bra and frequently to poke a hole therein. The only remedy for this problem noted in the prior art is incidentally mentioned in U.S. Pat. No. 4,153,062 wherein the use of short rubber cushions slipped on the ends of U-shaped underwire is referred to. Other art such as U.S. Pat. Nos. 3,722,513; 4,798,557; 4,440,174; and 3,726,286; disclose the use of the U-shaped support wire in various types of bra configurations wherein such support wire is contained loosely within pockets of such bras.

In this respect, the underwire bra according to the present invention substantially departs from the conventional concepts and designs of the prior art, and in so doing provides a means primarily developed for the purpose of securing an underwire in a bra so as to eliminate puncturing of the bra material by the ends of the U-shaped underwire.

Therefore, it can be appreciated that there exists a continuing need for new and improved underwire bras which can be used without failure due to fabric abrasure or puncture by such underwires. In this regard, the present invention substantially fulfills this need.

SUMMARY OF THE INVENTION

In view of the foregoing disadvantages inherent in the known types of underwire bras now present in the prior art, the present invention provides an improved underwire bra construction wherein the same can be utilized to provide a bra not susceptible to the damage inherent in present construction. As such, the general purpose of the present invention, which will be described subsequently in greater detail, is to provide a new and improved underwire bra and method of attachment of the wires which has all the advantages of the prior art underwire bras and none of the disadvantages.

To attain this, the present invention essentially comprises an improvement in underwire bra construction wherein the ends of the U-shaped underwire are secured to complementary fastening members affixed to the material of the bra cup and wherein such U-shaped underwire is free to swing up or down relative to said complementary fastening members.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved underwire bra which has all the advantages of the prior art bras and none of the disadvantages.

It is another object of the present invention to provide a new and improved underwire bra which may be easily and efficiently manufactured and marketed.

It is a further object of the present invention to provide a new and improved underwire bra which is of a durable and reliable construction.

An even further object of the present invention is to provide a new and improved underwire bra which is susceptible of a low cost of manufacture with regard to both materials and labor, and which accordingly is then susceptible of low prices of sale to the consuming public, thereby making such bras economically available to the buying public.

Still yet another object of the present invention is to provide a new and improved underwire bra which provides in the constructions of the prior art some of the advantages thereof, while simultaneously overcoming some of the disadvantages normally associated therewith.

Still another object of the present invention is to provide a new and improved more wear-resistant underwire bra.

Yet another object of the present invention is to provide a new and improved means for affixing U-shaped underwires in a bra construction.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIGS. 3 and 4 are enlarged perspective views of the fastening means for the U-shaped underwire shown in FIG. 2.

FIG. 5 is a top plan view of the element shown in FIG. 3.

FIGS. 6 and 7 are enlarged perspective views of a modification of the U-shaped wire illustrated in FIGS. 3 and 5.

FIGS. 8 and 9 are enlarged perspective views of a modified fastening means for the U-shaped underwire shown in FIG. 2.

FIG. 10 is a top plan view of the element shown in FIG. 8.

FIGS. 11 and 12 are enlarged perspective views of another means for securing the ends of a U-shaped underwire to a bra.

DESCRIPTION OF THE PREFERRED EMBODIMENT

Figure 1:
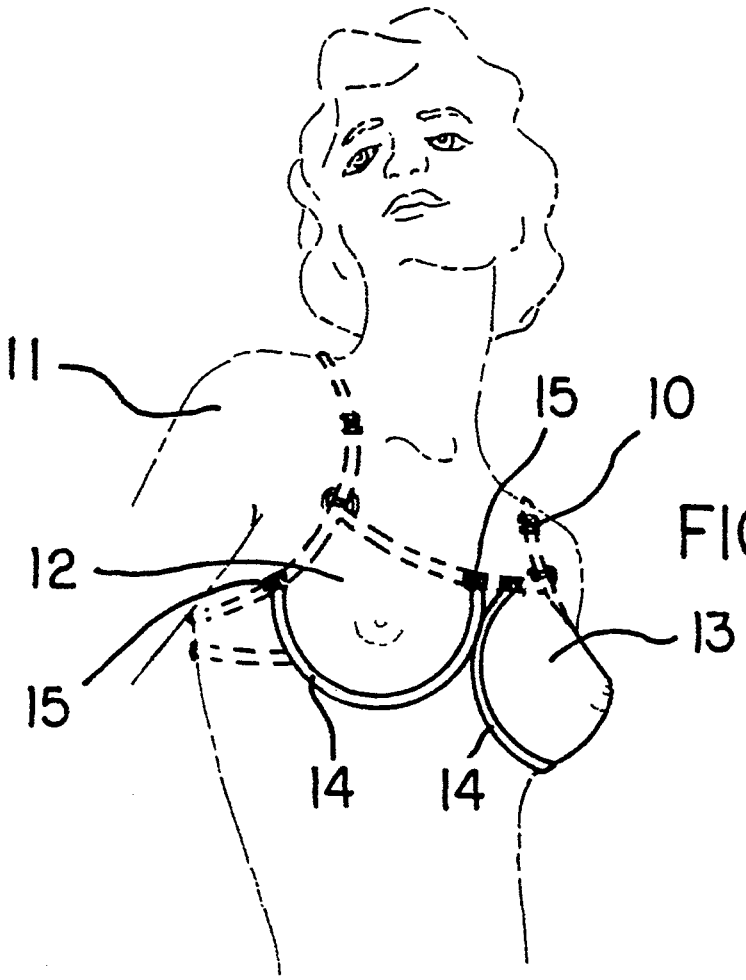
FIG. 1 is a perspective view of an underwire bra of the present invention in position on a user's body.

With reference now to the drawings, and in particular to FIG. 1 thereof, a new and improved underwire bra embodying the principles and concepts of the present invention and generally designated by the reference numeral 10 will be described.

The bra 10 embodying the present invention is shown in position on a wearer 11 (shown in broken lines), and consists of the conventional shoulder straps and bra cups 12 and 13. Inserted in the fabric of each of bra cups 12 and 13 at the lower edges thereof is a U-shaped wire member 14 having fastening means 15 secured to the fabric of the bra 10 and engaging with the ends of such U-shaped wire member 14. Obviously a strap-less bra utilizing the underwire arrangement of the present invention is also within the scope thereof.

Figure 2:
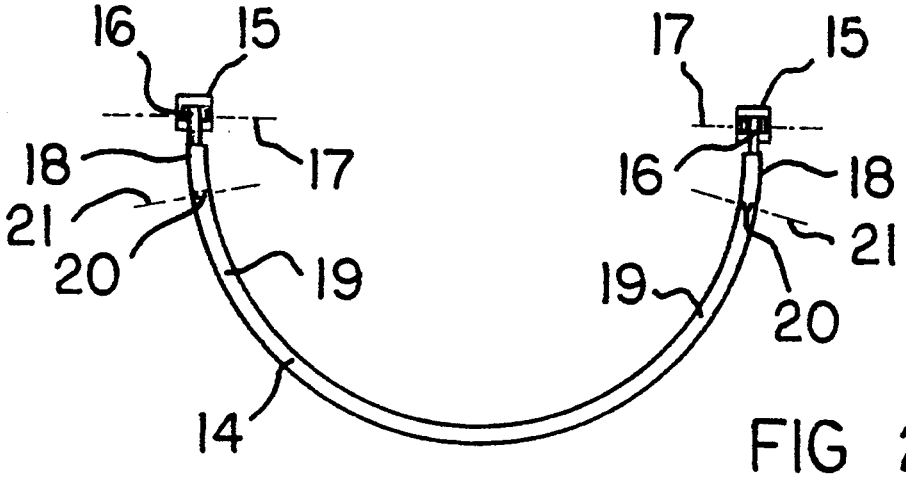
FIG. 2 is a plan view of one form of the present invention.

FIG. 2 shows in more detail one means for such engagement wherein the fastening means 15 is seen to provide a pivoted link 16 with the ends 18 of wire member 14, with such ends 18 free to pivot about the axis indicated by broken lines 17. Preferably, wire 14 is divided at each end into two segments 18 and 19 immediately below pivoted link 16, said segments 18 and 19 again being pivotally connected one to the other as at 20 and free to pivot about axis 21 shown in broken lines. These pivots at 16 and 20 allow for freedom of movement by the wearer while the engagement with means 15 prevents displacement of the ends 18 of wire member 14 other than in the pivotal motion described. It will be understood that underwire 14 has the same configuration at both fasteners so that segment 19 is common to both ends of such underwire 14, i.e. such underwire 14 has two end segments 18 and a single segment 19 therebetween.

FIGS. 3 and 4 show in greater detail the fastening means 15. As illustrated in this modification, the two-piece underwire 14 having the main segment 19 and end segment 18 has a flattened terminus 22 on the end of segment 18 having a hole 23 extending therethrough designed to accept a pivot pin (not shown). The fastening means 15 adapted to be sewn or otherwise attached to the fabric of the bra 10 as shown in FIG. 1, bears on its surface 24 a pair of complementary flanges 25 adapted to receive therebetween said flattened terminus 22 and to be secured thereto by a pivot pin extending through holes 26 in such flanges 25 and the corresponding hole 23 in said flattened terminus. When secured by such pivot pin, the unit makes up the pivotal link 16 shown in FIG. 2. As shown in FIG. 5, the segment 18 is then permitted to pivot about axis 17. Also as shown in the drawing, the main segment 19 is pivotally connected to end segment 18 at 27 where it is free to pivot about axis 21. While the division of underwire 14 into two segments is shown in the preceding figures, it may be formed in one piece with the flattened terminus 22 at the end thereof as shown in FIGS. 6 and 7 wherein the engagement with fastening member 15 is as described in connection with FIGS. 3 and 4.

FIGS. 8, 9, and 10 illustrate another type of fastening means 15-A wherein the pivoting of underwire 14 is solely at the junction 27 between segments 18 and 19. In this modification, a groove 28 is provided adjacent the end 29 of segment 18 adapted to engage within an open-ended slot 30 in means 15-A and to be held therein by the end 29 of segment 18.

FIG. 11 shows a minor modification 15-B of the fastening means 15 of FIGS. 6 and 7. Instead of flanges 25, here the securing means comprises a pair of U-shaped brackets 31 affixed to fastening means 15-B and adapted to receive a pivot pin 32 therein, extending through both brackets 31 and through the hole 23 in the flattened terminus 22 on the end of U-shaped underwire 14, thus permitting such underwire 14 to pivot about such pin 32.

Figure 13:
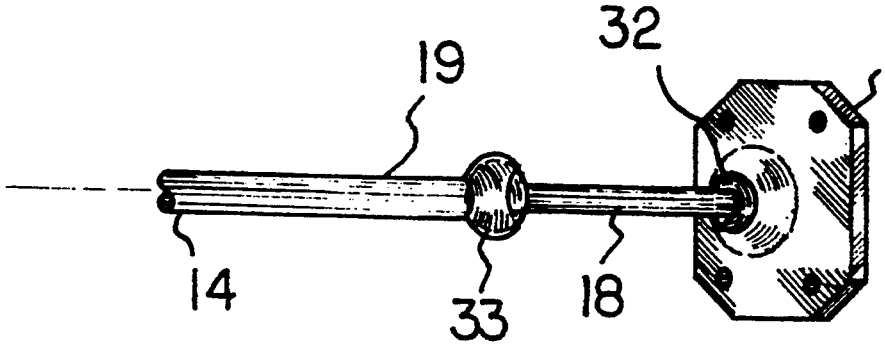
FIGS. 13 and 14 illustrate still another type of fastening means.
Figure 14:
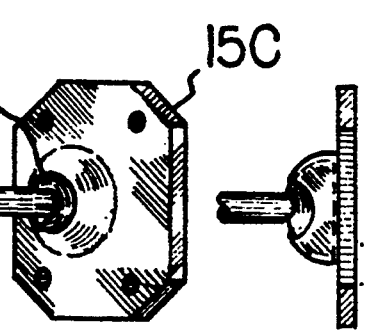
Figure 15:
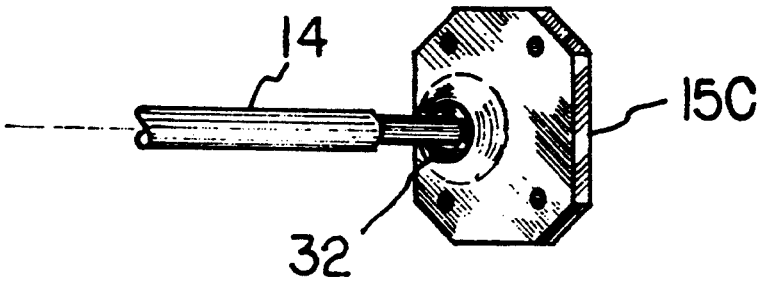
FIG. 15 shows the fastening means of FIG. 14 in relationship to another form of the U-shaped underwire.

In FIGS. 13 and 14, the pivoting of underwire 14 is achieved through the use of a ball and socket joint 32 having the socket portion thereof secured to fastening member 15-C and the ball portion thereof secured to the end of segment 18. Likewise a second ball and socket joint 33 forms the pivot means 27 at the juncture of segments 18 and 19. Again, as shown in FIG. 15, only the one ball and socket joint 32 may be used if desired.

Figure 16:
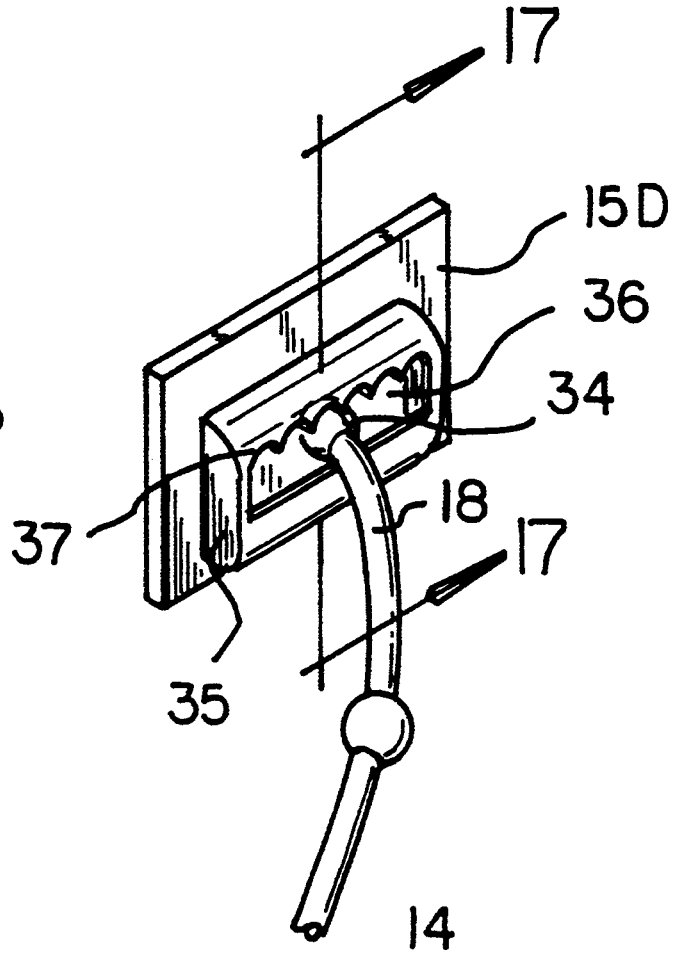
FIG. 16 shows still another type of fastener means.
Figure 17:
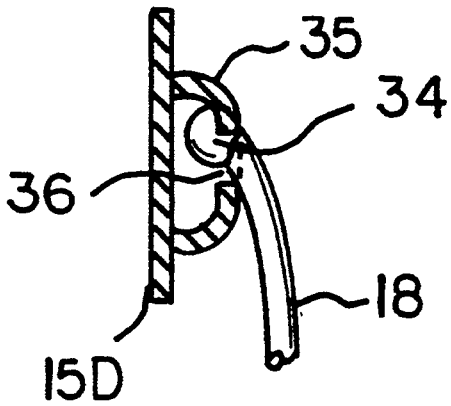
FIG. 17 is a sectional view on line 17—17 of the fastener means of FIG. 16.

FIGS. 16 and 17 illustrate a variation of the fastening means shown in FIGS. 13 and 14 wherein such fastening means 15-D permits lateral adjustment of the relationship between such fastening means 15-D and the associated U-shaped underwire 14. In this case, the end segment 18 of underwire 14 terminates in a ball-shaped member 34. Fastening means 15-D has a generally rectangular receptacle 35 affixed to the face thereof, said receptacle 35 having a laterally extending opening 36 in the face thereof. The portion of receptacle 35 defining the upper edge of opening 36 has a plurality of arcuate grooves 37 uniformly spaced there along. The opening 36 is such that ball-shaped member 34, when aligned with one of said grooves 37, will fit into said receptacle 35. When the underwire 14 is allowed to drop downward, the ball-shaped member 34 locks into place within said receptacle 35 as shown in FIG. 17. The multiple grooves 37 allow adjustment as shown in the lateral spacing of the end segment 18 of underwire 14 to permit adjusting for better fit on the wearer. Again, as shown in FIG. 16, the ball and socket point joint 33 between end segment 18 and the major segment 19 of underwire 14 permits pivoting of underwire 14 as described in connection with FIGS. 13 and 14 above.

Whereas most of the descriptions above relate to a single end of the U-shaped underwire, it is to be understood that the description of one side of the bra and the associated underwire is duplicated in actual construction; i.e. both ends of the underwire bra are secured in the same manner for each modification described.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved underwear bra which comprises: a bra having a pair of fabric breast cups; each of said fabric breast cups having a bottom base portion and an upper edge portion; first and second U-shaped underwires extending around the base portion of each said breast cup and being enclosed in the fabric of said bra; each of said first and second underwires having first and second opposed ends; first, second, third and fourth fastening members proximal to the the upper edge portions of each of said breast cups, respectively, and fastened to the fabric thereof to receive and secure the first and second opposed ends of each of said U-shaped underwires therein, respectively; and first, second, third and fourth pivotal coupling members attached to the opposed ends of said underwires, respectively, for permitting the opposed ends of said underwire to be affixed to said first, second third and fourth fastening members, respectively, and for permitting each opposed end of said first and second underwires, respectively, to pivot relative to the other end thereof and to the other ends of the other underwire.

2. A bra as in claim 1 wherein said U-shaped underwire is composed of a main segment and two end segments pivotally connected thereto.

3. A construction as in claim 1 wherein each said fastening member has mounted thereon a pair of extending flanges adapted to receive therebetween a corresponding opposed end of said U-shaped underwire to engage between said pair of flanges; and a pivot pin extending through said flanges and said opposed end to pivotally secure said end to said flanges.

4. A construction as in claim 1 wherein each said fastening member has an open bottom slot therein; each of said first and second underwire opposed ends has a groove thereon adjacent the corresponding opposed end thereof engaged within said slot with the corresponding opposed end of each said underwire being sufficiently large in diameter as to not pass through said slot, and wherein each of said opposed ends of said first and second underwires further includes a pivotal connection therein, respectively, to permit a main segment of each U-shaped underwire to pivot relative to the opposed ends thereof proximal to said corresponding fastener member.

5. A construction as in claim 1 wherein each said fastening member has a socket on the surface thereof; and each of said first and second underwire opposed ends has a ball on the corresponding end thereof adapted to fit within said socket.

6. A construction as in claim 1 wherein each said fastening member has a plurality of ball-receiving recesses on the surface thereof; and each of said first and second underwire opposed ends has a ball-shaped member on the corresponding end thereof adapted to engage within any of said plurality of ball-receiving recesses.

7. A construction as in claim 1 wherein each said first and second U-shaped underwire is formed of two minor opposed end segments and a major U-shaped central segment therebetween; and further includes means for pivotally connecting each said minor end segment to said central major segment.

* * * * *